United States Patent [19]

Tempère

[11] 4,083,655

[45] Apr. 11, 1978

[54] TURBINE ROTOR

[75] Inventor: Robert Tempère Aubervilliers, France

[73] Assignee: Groupe Europeen pour la Technique des Turbines a Vapeur G.E.T.T. S.A., Paris, France

[21] Appl. No.: 751,298

[22] Filed: Dec. 16, 1976

[30] Foreign Application Priority Data

Dec. 29, 1975 France ..... 75 39980

[51] Int. Cl.[2] ..... F01D 5/22

[52] U.S. Cl. ..... 416/196 R; 416/500

[58] Field of Search ..... 416/196, 196 A

[56] References Cited

U.S. PATENT DOCUMENTS

| | | | |
|---|---|---|---|
| 2,198,784 | 4/1940 | Mikina | 416/196 |
| 3,396,905 | 8/1968 | Johnson | 416/196 |
| 3,719,432 | 3/1973 | Musick et al. | 416/196 |
| 3,771,922 | 11/1973 | Tracy | 416/196 |
| 3,795,462 | 3/1974 | Trumpler | 416/196 |
| 3,990,813 | 11/1976 | Imai et al. | 416/196 R |

FOREIGN PATENT DOCUMENTS

| | | | |
|---|---|---|---|
| 1,252,763 | 12/1960 | France | 416/196 |
| 1,374,917 | 8/1964 | France | 416/196 |
| A69,842 | 12/1958 | France | 416/196 |
| 1,426,798 | 3/1969 | Germany | 416/196 |

*Primary Examiner*—Everette A. Powell, Jr.
*Attorney, Agent, or Firm*—Sughrue, Rothwell, Mion, Zinn and Macpeak

[57] ABSTRACT

A turbine rotor having twisted blades, are, in the vicinity of their radially outer portions integrally connected with each other to prevent any rotation in either direction of one blade in relation to its neighboring blades. The blades are prestressed during assembly by being un-twisted through an angle which is less than or equal to and in the same direction as the angle through which said blades would be un-twisted during rotation if they were free to rotate in relation to each other.

1 Claim, 4 Drawing Figures

TURBINE ROTOR

FIELD OF THE INVENTION

The present invention relates to the rotor stage of a turbo-machine.

BACKGROUND OF THE INVENTION

The stages of the present invention include blades which have a conventional twisted or cork-screw shape. They also include connection means fitted at or near the radially outer ends of the blades for making them integral with one another and preventing any rotation of a blade in either direction. Such means have been conventionally fitted to improve the vibration performance of the stage, and are particularly useful in the low pressure part of a turbine where the blades are longest.

When the turbine is in operation, forces are exerted on the blades which tend to make them straighten out or unwind their cork-screw shape (centrifugal force, driving fluid impact etc.). These rotary forces put a strain on the said connection means which can have undesirable effects on the connection means, the blades and any other stressed parts.

SUMMARY OF THE INVENTION

The present invention provides a mobile stage of a turbo-machine comprising twisted blades fitted in the vicinity of their radially outer portions with connection means making them integral with each other and preventing any rotation in either direction of one blade in relatio to its neighbouring blades, and wherein said blades are prestressed during assembly by bein un-twisted through an angle *a* which is less than or equal to and in the same direction as the angle *b* through which said blades would be un-twisted during rotation if they were free to rotate in relation to each other.

Thus, the operation stress depending on the un-twist angle *b* will be substracted from the prestress which is a function of the angle *a*.

In the particular case where *a* is equal to *b*, i.e. where the blade is assembled in the angular position which would be that of the rotating blade if the interconnection of blades did not exist, the effects of the un-twisting are completely cancelled due to the existence of the connection means.

Therefore the pre-stresses applied to the blade and its associated connection means (cap, lashing wire, zigzag, fin, arch bar, blade, built up shrouding, etc.) during assembly disappear during operation of the turbine. These assembly stresses are not detrimental to the blades since they are large only when the rotor is static and there are no other forces acting on the blades to add to the prestressing.

An embodiment of the present invention is described by way of example with reference to the accompanying drawing in which:

DESCRIPTION OF THE PREFERRED EMBODIMENT

Figure 1:
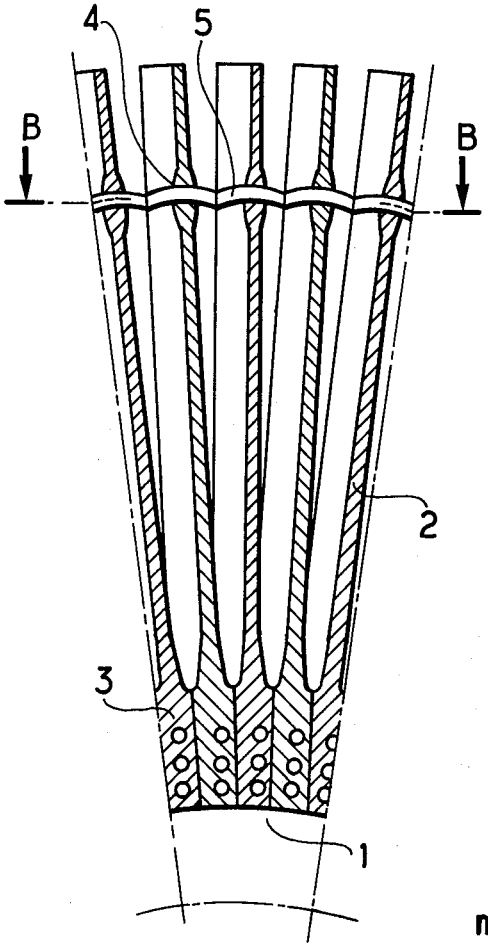
FIG. 1 is a vertical cross-section of rotor blades in accordance with the present invention.

The rotor stage shown in FIG. 1 comprises a disc 1 and blades 2 which have a cork-screw shape and which are fixed on the disc 1 by their roots 3.

Figure 2:
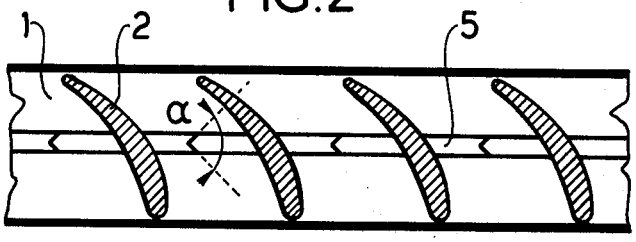
FIG. 2 is a horizontal section along a line B—B in FIG. 1.

Each blade 2 is provided with a hole 4 through its radially outer portion which is threaded by a peg 5. The peg 5 is in the shape of a curved wire having one end with a groove including an angle $\alpha$ and its opposite end with a matching wedge shape of angle $\alpha$ (see FIG. 2).

Figure 3:
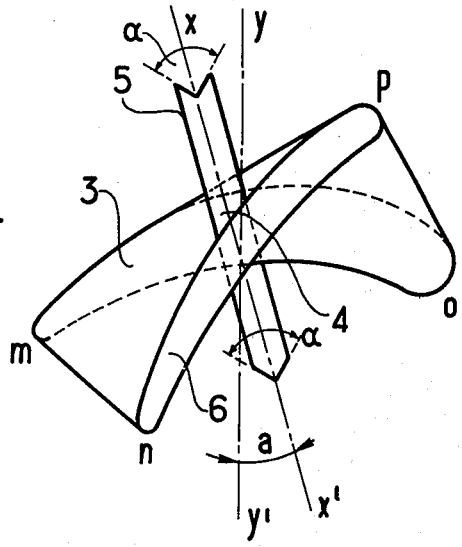
FIG. 3 is a top view of a blade before assembly.

FIG. 3 is a top view of a blade before assembly. This blade comprises a leading edge *mn* and a trailing edge *op* extending from the root 3 and the top part 6 of the blade.

The hole 4, in which the peg 5 is placed, has an axis $x$–$x'$ which forms an angle *a* with the axis of the root 3 of the blade 2 which is parallel to the axis $y$–$y'$ of the turbo-machine.

If the blades were free, i.e., had no connecting means between them, they would be elastically deformed, i.e., straightened out or unwound through an angle *b* under the effect of the forces applied thereto in operation (the point *n* draws nearer to the point *m* and the point *p* draws nearer to the point *o*).

The angle *b* is equal to the angle between the axis of the peg 5 before assembly and the axis along which the peg would lie during operation of the turbo-machine if the blades were free, i.e., if there were no peg between neighbouring blades.

Figure 4:
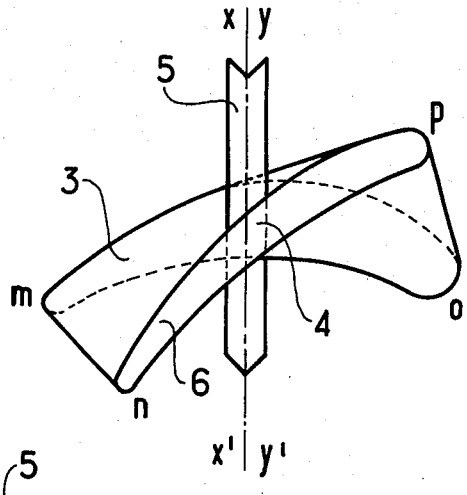
FIG. 4 is a top view of the blade after assembly.

In FIG. 4 the blade is twisted (i.e., unwound) and the axis $x$–$x'$ of the peg is parallel to the axis $y$–$y'$ of the root. All the pegs of the blades are interlocked with each other, with the wedges in grooves, so that all the blades are integral with each other and that no blade can turn in relation to the neighbouring blades when the turbo-machine starts rotating.

To ensure that the twist is applied on assembly of the blades, the axis of each peg is displaced during machining of the blades by an angle *a* which is less than or equal to and in the opposite direction to the unwinding angle *b* of the rotating blade.

Although the rotor of the turbo-machine which has just been described appears the most advantageous for implementing the invention, it will be understood that various modifications can be made thereto without going beyond the scope of the invention as defined in the claims, it being possible to change or replace some of its elements by other elements which are capable of fulfilling the same technical function or an equivalent technical function therein; in particular, the pegs could be replaced by any connection means making the blades fast to one another and which would therefore prevent any rotation in either direction of a blade in relation to the neighbouring blades, e.g., a cap, lashing wire, a zigzag, a fin, an arch bar, built up shrouding, etc., the axis of said connection means when the blades are machined and in relation to its assembled position being displaced by an angle *a* less than or equal to and in the opposite direction to the unwinding angle of the rotating blade.

What is claimed is:

1. A mobile stage of a turbo-machine comprising: a plurality of radially extending twisted blades, connection means fitted to each blade in the vicinity of their radially outer portions for making them integral with each other and for preventing rotation in either direction of one blade in relation to its neighbouring blades, and said blades being prestressed during assembly by being un-twisted through an angle a which is less than or equal to and in the same direction as the angle b through which said blades would be un-twisted during rotation if they were free to rotate in relation to each other.

* * * * *